US006178683B1

(12) United States Patent
Williams

(10) Patent No.: US 6,178,683 B1
(45) Date of Patent: Jan. 30, 2001

(54) RELOADER FOR LOADING CARTRIDGES INTO A MAGAZINE

(76) Inventor: Lawrence R. Williams, 2644 W. Campo Alegre, Mesa, AZ (US) 85202

( * ) Notice: Under 35 U.S.C. 154(b), the term of this patent shall be extended for 0 days.

(21) Appl. No.: 09/197,841

(22) Filed: Nov. 23, 1998

(51) Int. Cl.[7] ..... F41A 9/83
(52) U.S. Cl. ..... 42/90
(58) Field of Search ..... 42/87, 88, 90

(56) References Cited

U.S. PATENT DOCUMENTS

| | | | | |
|---|---|---|---|---|
| 4,464,855 | * | 8/1984 | Musgrave | 42/87 |
| 4,570,371 | * | 2/1986 | Mears | 42/90 |
| 4,689,909 | * | 9/1987 | Howard | 42/87 |
| 4,719,715 | * | 1/1988 | Howard | 42/87 |
| 4,827,651 | * | 5/1989 | Conkey | 42/87 |
| 4,829,693 | * | 5/1989 | Holmes | 42/87 |
| 4,888,902 | * | 12/1989 | Knowles | 42/90 |
| 4,993,180 | * | 2/1991 | Upchurch | 42/87 |
| 5,129,173 | * | 7/1992 | Kuykendall | 42/90 |
| 5,249,386 | * | 10/1993 | Switzer | 42/87 |
| 5,355,606 | * | 10/1994 | Origoni | 42/87 |
| 5,377,436 | * | 1/1995 | Switzer | 42/87 |
| 5,402,594 | * | 4/1995 | Switzer | 42/90 |

FOREIGN PATENT DOCUMENTS

| | | | | |
|---|---|---|---|---|
| 304379 | * | 2/1921 | (DE) | 42/87 |

* cited by examiner

*Primary Examiner*—Darren W. Ark
(74) *Attorney, Agent, or Firm*—Gregory J. Nelson

(57) ABSTRACT

A reloader for a magazine having a generally L-shaped grip with a plurality of pairs of bores in the opposite end walls. The pairs of bores are selectively spaced so as to removably receive the pins on a plunger assembly. The magazine to be reloaded is held against the interior of the grip and the plunger may be manually depressed to depress the follower in the magazine allowing the user to insert cartridges with his or her free hand.

6 Claims, 4 Drawing Sheets

RELOADER FOR LOADING CARTRIDGES INTO A MAGAZINE

FIELD OF THE INVENTION

The present invention relates to a reloader for loading cartridges and more particularly to a re-loader which may be used to load cartridges of magazines of the type commonly used with handguns as well as some rifles and automatic weapons.

BACKGROUND OF THE INVENTION

Ammunition magazines hold a plurality of rounds of cartridges in stacked relationship within the magazine. The magazine is inserted into the receiver of the firearm such as a semi-automatic handgun and during firing operation the cartridges are fed into the chamber with the upper most cartridge being ejected from the magazine into the firearm.

A magazine typically has an elongate housing with a spring loaded follower slidably positioned therein. The bottom of the magazine is closed and the upper end is open and is the ejection end. The cartridges are loaded sequentially within the magazine against the spring force exerted by the follower. There are several cartridge stacking arrangements including an arrangement where the cartridges are vertically aligned within the magazine and others where the cartridges are vertically offset with respect to one another.

In order for the magazine to properly operate, a substantial spring force must be exerted in order to properly force or reject the cartridges from the upper end of the magazine. It is conventional practice to manually reload the magazine after all of the cartridges have been expended. Normally this is done by compressing the follower and the compression spring from the open top of the clip and sliding replacement cartridges into the magazine in a somewhat angular orientation as the follower and spring are compressed. As additional cartridges are positioned in the magazine, the spring becomes more difficult to compress.

Because of the difficulty in manually reloading clips, various devices can be found in the prior art which are reloader devices which will assist the user in the reloading operation by either holding the magazine in a position or assisting in compressing the follower and the spring. Representative patents directed to reloaders of different types include the following.

U.S. Pat. Nos. 5,249,386 and 5,377,436 both show a cartridge clip reloader which has a sleeve which receives the clip in seated relationship during reloading. A plunger is manually reciprocal to depress the top cartridge in the cartridge clip to accommodate receiving another cartridge. An operator arm connected to the plunger is manually operable by the user's thumb so the user may insert the cartridges into the clip with the other hand.

U.S. Pat. Nos. 4,719,715 and 4,689,909 both show similar magazine charger devices having a body with a spring and an open end for receiving the magazine to be loaded. A plunger operates to sequentially depress the upper-most cartridge to facilitate feeding a cartridge into the magazine.

U.S. Pat. No. 4,464,855 shows a device for filling magazines which has a channel shaped side with a tray at the end. The tray is dimensioned so that it fits into the magazine. The device is positioned against the side of the magazine and is pulled downwardly to compress the spring within the magazine.

U.S. Pat. No. 5,355,606 shows a device for loading ammunition which is in the form of an elongated housing to which is mounted a manually depressable rod. The housing is mounted in a fixed position on the exterior of the clip. Depressing the actuator will cause the cartridges contained within the clip to be moved downwardly.

It is noted that in the prior art, holders for a plurality of cartridges are sometimes referred to as "clips" and other times as "magazines". It is believed that the term "magazine" is more accurate and will be used herein to broadly cover cartridge holders and is intended to encompass both devices referred to as "clips" and those referred to as "magazines".

SUMMARY OF THE INVENTION

Briefly, the present invention relates to a reloader for assisting the user in manually loading cartridges into a magazine. The reloader of the present invention is universal and may be used with a wide variety of magazines such as most all magazines intended for use with center fire, semi-automatic handguns in the range of 0.25 to 0.50 caliber. The reloader will load cartridges both in magazines which accommodate cartridges in either a single or double wide spacing. In addition to being applicable to assist in the loading of magazines for semi-automatic handguns, the reloader also has application to magazines for other weapons such as some rifles and machine guns.

The reloader has a grip with two members at 90°C. which form a general L-shape. The grip has a plurality of pairs of bores along both the upper and lower ends of the grip. The bores are selectively spaced to receive depending pins of a plunger mechanism. While the spacing between each pair of holes in each set is the same so as to accommodate the removable plunger mechanism, the relative positioning of the pairs of holes on the ends of the grip with respect to the intersection of the members forming the grip varies so the relative position of the plunger to the grip may be selectively varied. The magazine to be loaded is placed against one of the inner surfaces of the grip and the plunger mechanism is positioned in a selected pair of holes so as to align with the center of the magazine. The user then grasps the grip and the magazine with one hand so the plunger may then be depressed with the thumb of the hand holding the magazine and grip. The plunger will depress the follower and spring within the magazine. This then allows the user to insert the cartridges one at a time into the open or injection end of the magazine with the user's free hand. The plunger may be selectively positioned in the holes at the ends of the grip to accommodate magazines of varying sizes, shapes and calibers.

BRIEF DESCRIPTION OF THE DRAWINGS

The above and other objects and advantages of the present invention will become more apparent from the following description, claims and drawings in which:

DETAILED DESCRIPTION OF THE DRAWINGS

Turning now to the drawings, particularly FIGS. 1 to 6, the reloading device of the present invention is generally designated by the numeral 50 and is adapted for use with magazines of various types and sizes for use in connection with various calibers of cartridges. Generally, the reloader 50 is useable to reload magazines for substantially all center fire cartridges in the range of 0.25 to 0.50 caliber as well as some other magazines for rifles and machine guns.

Figure 1:
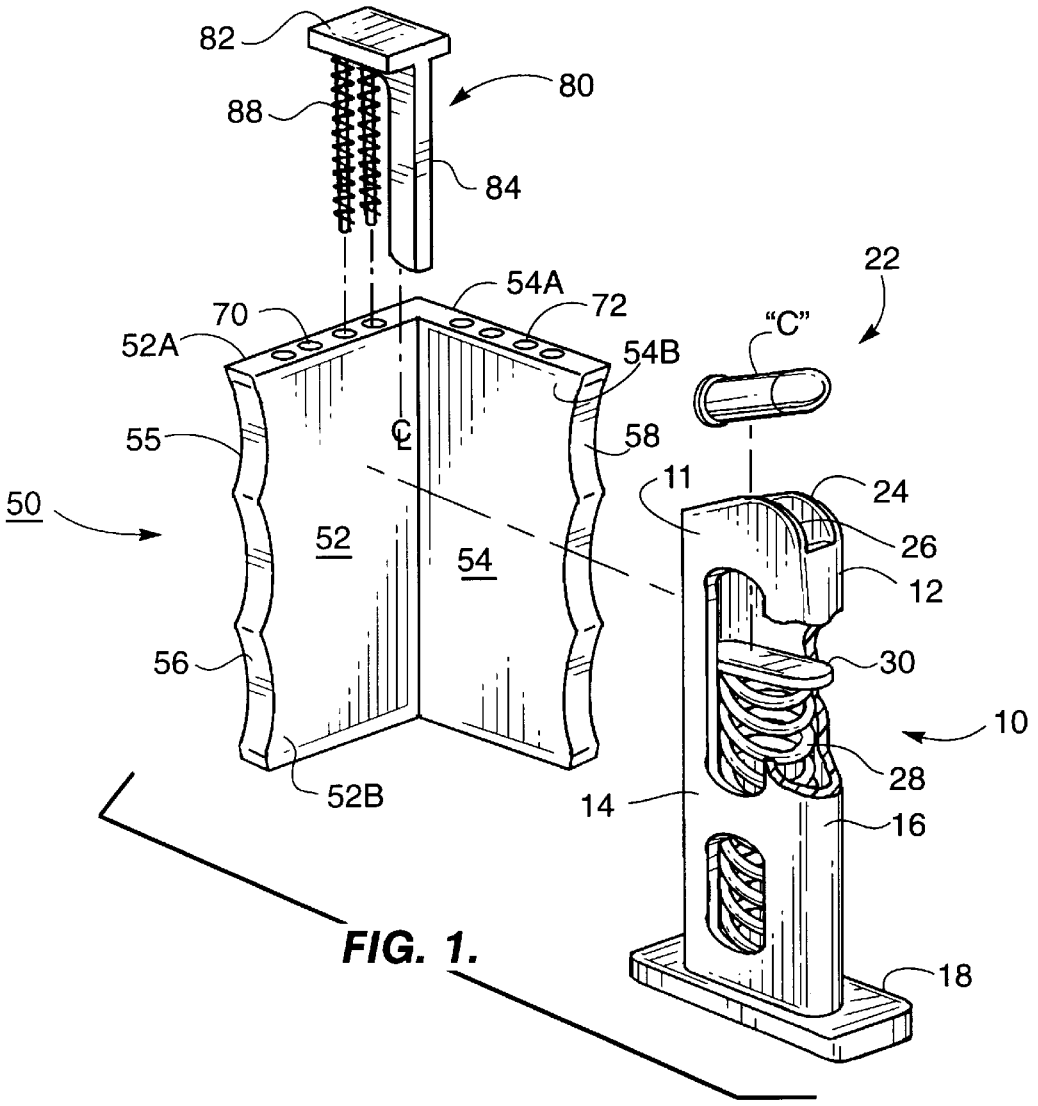
FIG. 1 is a perspective view of the magazine reloader of the present invention shown with a representative magazine.
Figure 2:
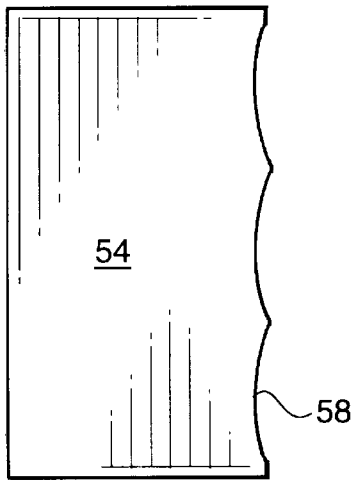
FIG. 2 is a side view of the reloader as viewed from the right side of FIG. 1.

A representative magazine 10 is seen in FIG. 1 and has a housing 11 with opposite side walls 12 and 14 and end walls 16 and a closed lower end 18. The upper end of the magazine is open and defines an ejection slot 22 between the upwardly slightly converging upper ends 24, 26 of the side walls. A compression spring 28 is reciprocably contained within the magazine housing 11. The bottom of the end of the compression spring bears against the inner surface of the lower end 18 of the magazine and the upper end of the spring engages a follower 30 which, as the spring is compressed, imparts a spring biasing force to the cartridges "C" within the magazine.

To reload the magazine 10, the spring 28 and follower 30 are downwardly compressed and, as they are compressed, additional cartridges "C" may be laterally inserted in the upper or injection slot 22 of the magazine between ends 24 and 26.

The reloader of the present invention may be used with magazines of the general type described above and is seen in FIGS. 1 to 6. The reloader 50 has a grip 55 comprised of a pair of wall members 52, 54 positioned at right angles with respect to one another at corner 56. Wall member 52 has an outer planar surface 52A and an inner planar surface 52B. Similarly, wall member 54 has an outer planar surface 54A and an inner planar surface 54B. The opposite vertical side edges of members 52, 54 are each formed having a plurality of arcuate recesses 56 and 58 respectively, which are sized to accommodate and conform to the fingers of the user. Typically, the curvature of each of these recesses would be approximately one inch in diameter which will comfortably fit the fingers of most users. The overall height of the grip may vary but typically will be approximately 3" or so. The grip can be made from any suitable material and may be metal or molded from a high strength plastic.

Figure 4:
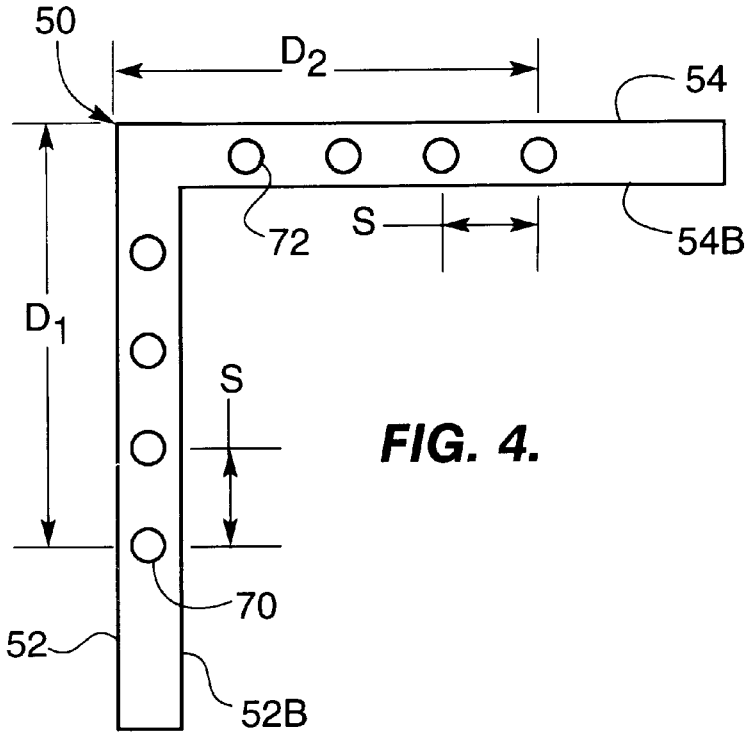
FIG. 4 is a top end view of the loader of the present invention.
Figure 5:
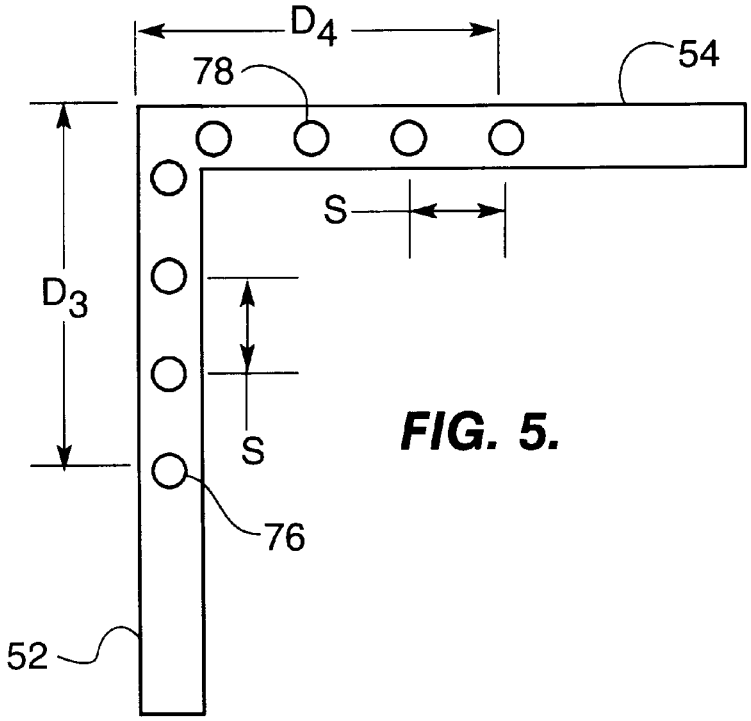
FIG. 5 is a view of the opposite end of the reloader as seen in FIG. 4.

As seen in FIGS. 4 and 5, the grip has a general L-shape. Looking at the upper end of wall 52, as seen in FIG. 4, it will be seen that wall 52 defines a plurality of blind bores 70 all having substantially the same diameter. The holes are spaced-apart an equal distance "S". Two pairs of bores or four total, are provided in the end of wall 52. The distance D1 from the intersection 56 of outside surfaces 52 and 54 is predetermined and typically is 1.1". Looking at the end of wall 54, this surface also defines a plurality of blind bores 72 of a predetermined diameter which corresponds to the diameter of bores 70. Again, the spacing "S" between the bores is substantially the same. However, the distance D2, which is the distance measured from the intersection of surfaces 52 and 54, is selected so as to be less than D1, typically 1.050". It will be seen the top end of wall 54 has a total of two pairs or four holes. As will be explained hereafter, these bores are for the reception of a plunger mechanism 80 and by varying the location of the plunger in the bores, the reloader can be adjusted to accommodate various calibers and types of magazines.

In looking at the opposite lower ends of walls 52 and 54, as seen in FIG. 5, again each define a plurality of bores 76 and 78, respectively, with two pairs or four bores being provided in the end of each wall 52, 54. The bores 76, 78 are substantially the same diameter as the holes in the opposite end wall surfaces of each of these members. However, distance D3 which is the distance measured from the intersection of surfaces 52 and 54 along wall 52 is less than D2 and typically may be 1". The spacing "S" between the holes remains constant and may be, for example, 0.250".

Figure 3:
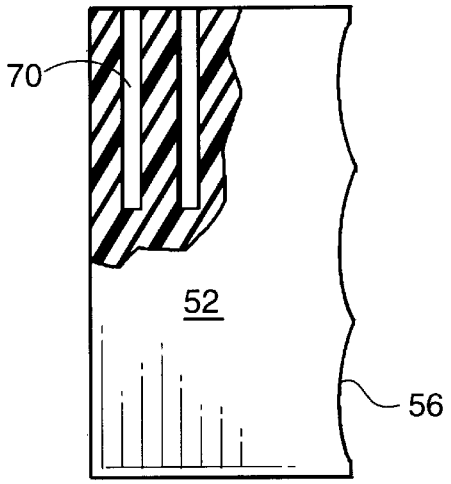
FIG. 3 is a side view of the reloader as viewed from the left side of FIG. 1 partly broken away.

Distance D4 along wall 54, as shown in FIG. 5, is selected so as to be less than D3 and typically is 0.950". Again, the spacing "S" between the individual bores remains the same. As best seen in FIG. 3 the bores in the walls are blind bores extending in parallel arrangement. Additional bores may be provided although it has been found that the spacing described will accommodate most all magazines for semi-automatic handguns between 0.25 and 0.50 caliber.

Figure 6:
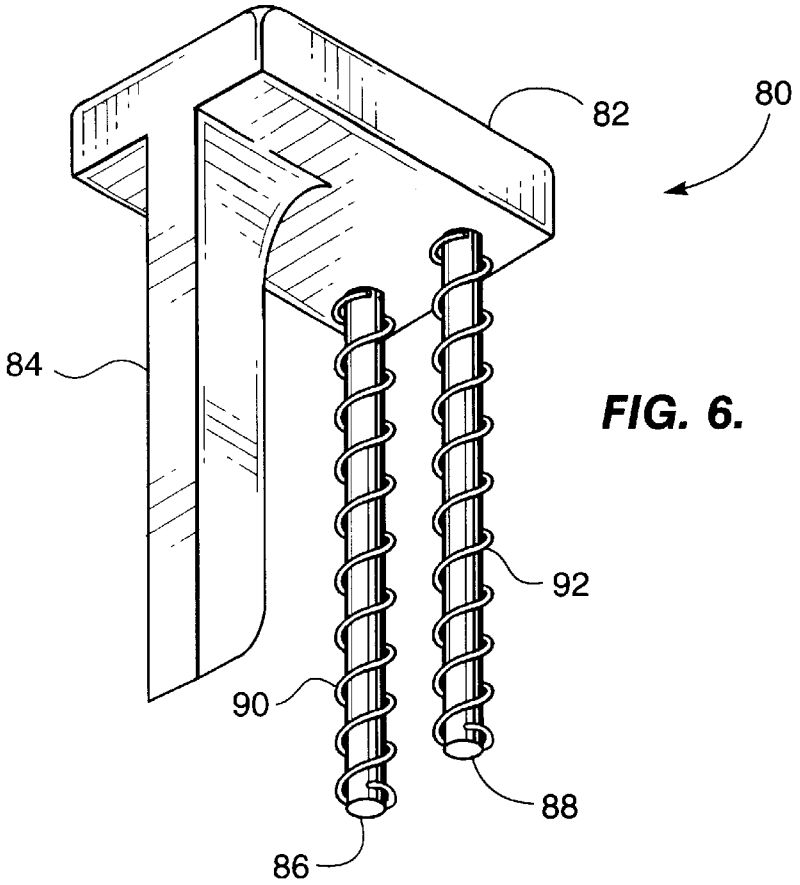
FIG. 6 is a perspective view of a plunger with the plunger inverted from its normal use position to better show the constructional details.
Figure 7:
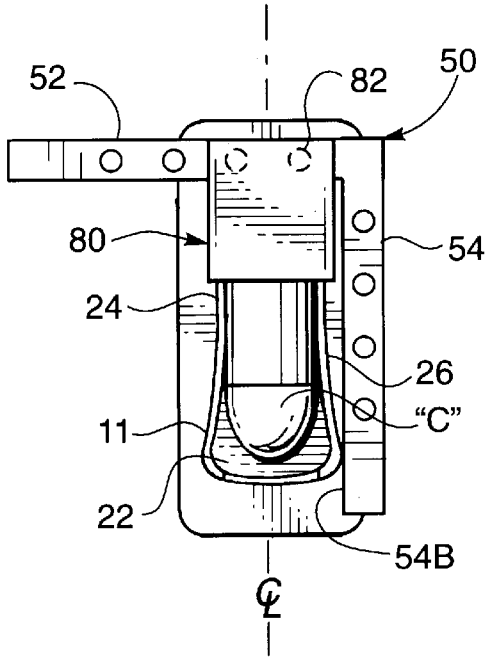
FIGS. 7 to 9 illustrates the use of the loader of the present invention shown in connection with a magazine.

A plunger assembly 80 is best seen in FIG. 6 and comprises key or pad 82 from which depends a downwardly extending rod 84 at a right angle. In FIG. 6, the plunger is shown inverted to better illustrate the details of its construction. A pair of pins 86 and 88 also extend downwardly from the lower surface from the pad. The pins are of a diameter slightly less than the diameter "S" of bores at the opposite ends of the grip. Typically the bores are 0.010" to 0.012" greater in diameter than the pins to accommodate insertion and removal. Compression springs 90 and 92 extend around the pins. As best seen in FIGS. 1 and 7, the pins may be inserted in a selected pair of bores at the end of the grip and the plunger manually pressed downwardly against the biasing force of the compression springs. The downwardly depending leg 84 will assume a position spaced from the interior surface of a selected associated wall 52, 54 of the grip.

Referring now to FIGS. 1, 7 to 9, the reloader of the present invention will be better understood from the following description of use.

The magazine 10 to be reloaded will be positioned having one side wall abutting one of the inner surfaces 52 or 54 of the grip. In FIG. 7, the magazine sidewall 11 is shown abutting grip wall surface 54B. The user will visually align the transverse centerline of the cartridge "C" with respect to the various pairs of holes 70 in the end wall. If the centerline of the magazine does not align with the centerline CL of one of the pairs of bores for example along the upper end of walls 52 and 54, the user may then simply reverse the magazine with respect to the grip. Once the magazine is properly positioned with the magazine wall abutting a selected inner surface of the grip with the axial centerline of the magazine closely aligned with the centerline of one of the pairs of holes, the plunger 80 may then be inserted into the selected pairs of holes. In FIGS. 1 and 7, the centerline is designated as CL. In this position, the leg 84 will then be aligned directly with the centerline of the magazine and the cartridges "C" to be inserted.

Figure 8:
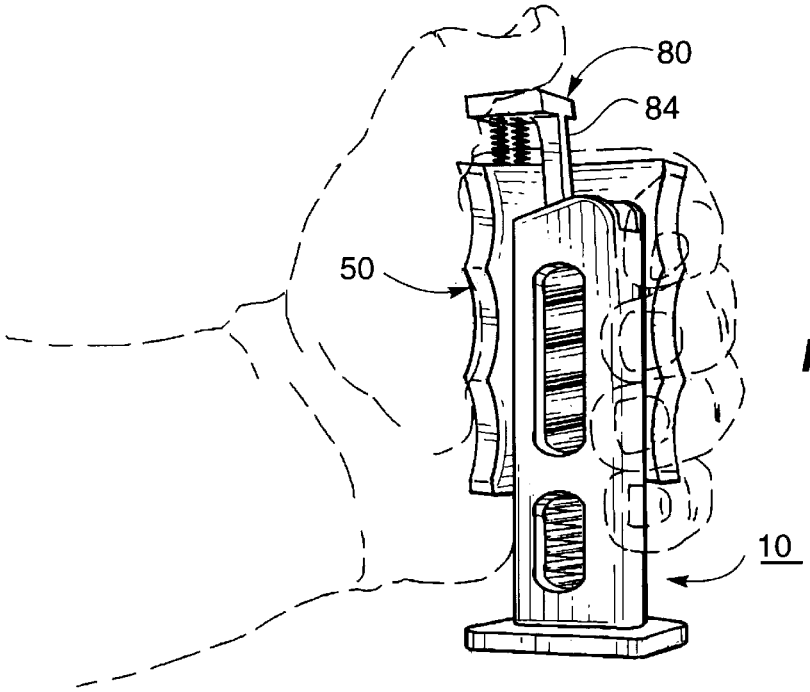
Figure 9:
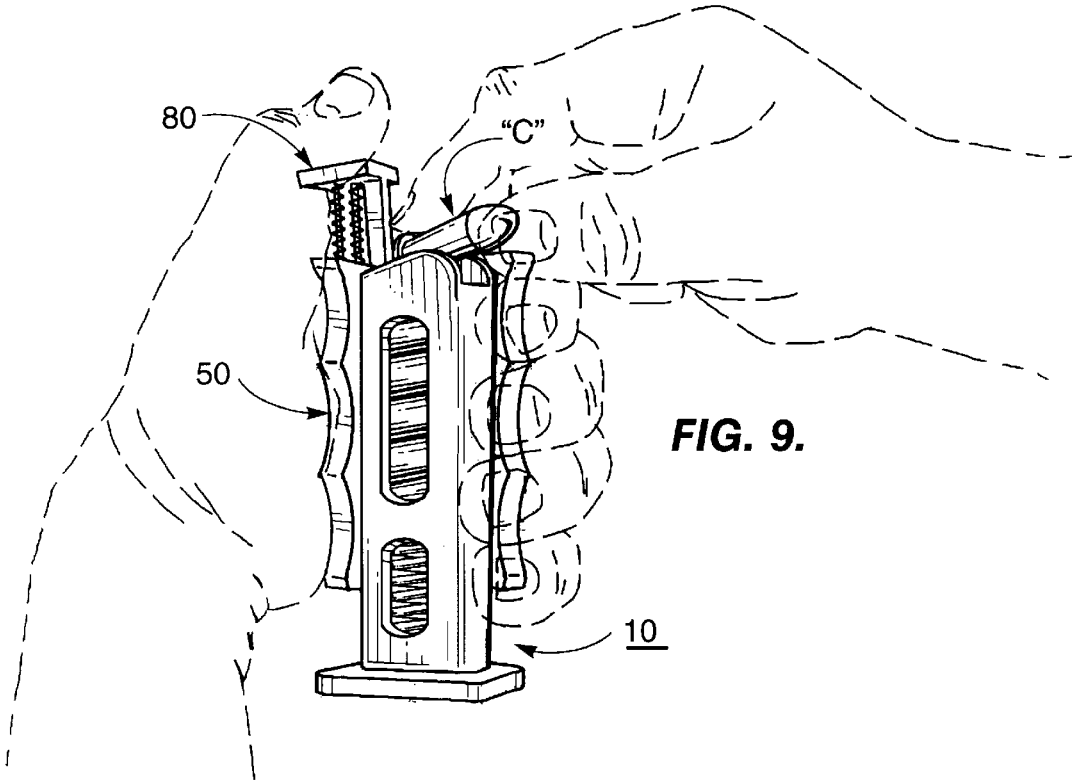

As best seen in FIG. 8, the user may then grasp the grip 50 with one hand and with the ends of the fingers maintain the magazine in position against the interior wall of the grip members. The fingers will comfortably seat in the recesses 56 or 58. With the thumb extended upwardly, the user may now apply downward pressure on the upper surface of the pad of the plunger assembly. The pressure on the upper surface of the pad 82 will depress the plunger by compressing the springs associated with the pins. As the plunger is depressed, downwardly depending rod 84 will depress the follower within the magazine downwardly. This allows the user to insert a first cartridge using the free hand. This operation is continued until the magazine is loaded to capacity.

Thus, the reloader of the present invention can be employed with a wide range of magazines and is particularly adapted for use with magazines for use with semi-automatic handguns in the .25 to .50 caliber range. Thus, the device is highly versatile and the gun owner may use the device with a number of handguns not being required to have a number of magazine reloading devices for various magazine and cartridge calibers. The device is easy to use and can be used with both magazines which stack the cartridges in a single, vertical row or in an offset, double wide arrangement. Use of the device leaves one hand free for easy insertion of the cartridges. The cartridges are loaded sequentially within the magazine by using the plunger to oppose the compression force exerted by the spring and follower.

It will be obvious to those skilled in the art to make various changes, alterations and modifications to the loader of the present invention. To the extent such changes, alterations and modifications do not depart from the spirit and scope of the appended claims, they are intended to be encompassed therein.

I claim:

1. A reloader for a cartridge magazine having a housing with an open ejection end and a follower therein, said reloader comprising:

(a) a grip having first and second members generally secured perpendicular to one another, said members having top and bottom surfaces which define a plurality of receiving means at predetermined locations on said surfaces; and (b) a plunger assembly having mounting means detachably securable at said receiving means whereby the relative position of said plunger assembly on said members may be selectively established, said plunger assembly having a plunger rod manually reciprocable along a selected of said members in a use position whereby the user may grasp the grip with one hand maintaining a magazine against one of said members and whereby the plunger assembly may be selectively positioned with the plunger rod aligned with the open ejection end of the magazine and when the plunger assembly is manually depressed said plunger rod will engage the top of the follower to depress the follower allowing a cartridge to be manually inserted therein.

2. A reloader for a cartridge magazine having a housing with an open ejection end and a follower therein, said reloader comprising:

(a) a first wall;

(b) a second wall, said first and second walls being connected generally perpendicular to one another to form a grip having an outer surface, an inner surface, vertical side edges and top and bottom edges;

(c) at least one of said edges defining bores therein;

(d) a plunger assembly including a pad with at least one depending pin insertable in a selected of said bores in a use position, a plunger rod depending from said pad and in a use position is positioned adjacent the inner surface of the grip whereby the user may grasp the grip with one hand maintaining a magazine against the inner surface of the grip with the plunger rod generally aligned with the center of the open ejection end of the magazine and whereby the plunger assembly may be manually depressed to depress the follower to facilitate insertion of a cartridge.

3. The reloader of claim 2 wherein said vertical side edges define recesses to accommodate the fingers of the user.

4. The reloader of claim 2 wherein said at least one of said edges further comprises said top edges of the grip which define a plurality of pairs of spaced bores in each of said first and second walls with each pair being located a predetermined different distance from the other of said first and second walls.

5. The reloader of claim 4 wherein said at least one pin comprises a pair of spaced-apart pins each having biasing means associated therewith.

6. The reloader of claim 2 wherein said first and second walls are integrally formed of plastic.

* * * * *